US008272242B1

(12) United States Patent
Lee et al.

(10) Patent No.: US 8,272,242 B1
(45) Date of Patent: Sep. 25, 2012

(54) MECHANICAL-COMBINATION DOOR LOCK

(76) Inventors: Miko Lee, New Taipei (TW); Hung-Lin Liao, New Taipei (TW)

( * ) Notice: Subject to any disclaimer, the term of this patent is extended or adjusted under 35 U.S.C. 154(b) by 0 days.

(21) Appl. No.: 13/160,642

(22) Filed: Jun. 15, 2011

(51) Int. Cl.
*A45C 13/10* (2006.01)

(52) U.S. Cl. ..... 70/284; 70/314; 70/279.1; 70/91; 70/472

(58) Field of Classification Search ..... 70/284, 70/285, 21, DIG. 63, DIG. 71, 312, 314–318, 70/213–216, 221–224, 91, 279.1, 472
See application file for complete search history.

(56) References Cited

U.S. PATENT DOCUMENTS

| | | | | |
|---|---|---|---|---|
| 4,520,641 | A * | 6/1985 | Bako | 70/312 |
| 4,719,776 | A * | 1/1988 | Molnar | 70/312 |
| 5,291,766 | A * | 3/1994 | Eisermann | 70/276 |
| 6,508,089 | B1 * | 1/2003 | Tsai | 70/213 |
| 6,575,004 | B2 * | 6/2003 | Berton et al. | 70/313 |
| 6,619,083 | B2 * | 9/2003 | Hartel et al. | 70/208 |
| 6,722,169 | B2 * | 4/2004 | Segawa | 70/208 |
| 7,444,844 | B1 * | 11/2008 | Lee | 70/21 |
| 7,516,633 | B1 * | 4/2009 | Chang | 70/472 |
| 7,614,266 | B2 * | 11/2009 | White et al. | 70/58 |
| 8,087,274 | B2 * | 1/2012 | Yu et al. | 70/284 |
| 2007/0214850 | A1 * | 9/2007 | Ma | 70/284 |
| 2012/0036903 | A1 * | 2/2012 | Lee | 70/91 |

* cited by examiner

*Primary Examiner* — Suzanne Barrett
*Assistant Examiner* — Myles Throop
(74) *Attorney, Agent, or Firm* — patenttm.us

(57) ABSTRACT

A mechanical-combination door lock has a housing assembly, a lever assembly, a disable mechanism and a combination mechanism. The housing assembly is adapted to securely mount on a door. The lever assembly is mounted though the housing assembly and has a lock body, a lock bolt, an outer lever, an inner lever, a lock core, a lock rod and a linking gear wheel. The disable mechanism is mounted in the housing assembly above the lever assembly and has a retaining ring, a resetting resilient element and a turning rod. The combination mechanism is mounted in the housing assembly and has a pintle, multiple sleeves and multiple wheels. The mechanical-combination door lock has mechanical-combination detection and resetting functions and is allowed to be temporarily disabled while the door is open.

13 Claims, 13 Drawing Sheets

MECHANICAL-COMBINATION DOOR LOCK

BACKGROUND OF THE INVENTION

1. Field of the Invention

The present invention relates to a mechanical-combination door lock, especially to a mechanical-combination door lock that is disposed on a door, has mechanical-combination detection and resetting functions and is allowed to be temporarily disabled while the door is open.

2. Description of the Prior Art(s)

A combination lock is a simple lock, is commonly used, is locked or unlocked by turning wheels and obviates the risk of losing a key. The combination lock is used on a door and is connected to a latch of the door. A handle of the door is rotatably as the combination lock is unlocked, or the handle of the door is unable to rotate as the combination lock is locked.

However, when a combination of a conventional combination lock is forgotten, to remove the conventional combination lock usually requires breaking the conventional combination lock. Thus, people must remember every single combination of all conventional combination locks to successfully unlock them.

Moreover, when the conventional combination lock is unlocked and the door is opened, to prevent someone peeping the combination secretly, the wheels should be disarranged. Once the wheels are disarranged, the conventional combination lock is locked again and the handle is unable to rotate again. Therefore, to people whom forgetting the combination easily or passing through the door repeatedly, the conventional combination lock is inconvenient.

To overcome the shortcomings, the present invention provides a mechanical-combination door lock to mitigate or obviate the aforementioned problems.

SUMMARY OF THE INVENTION

The main objective of the present invention is to provide a mechanical-combination door lock that is disposed on a door, has mechanical-combination detection and resetting functions and is allowed to be temporarily disabled while the door is open.

The mechanical-combination door lock in accordance with the present invention has a housing assembly, a lever assembly, a disable mechanism and a combination mechanism. The housing assembly is adapted to securely mount on a door. The lever assembly is mounted though the housing assembly and has a lock body, a lock bolt, an outer lever, an inner lever, a lock core, a lock rod and a linking gear wheel. The disable mechanism is mounted in the housing assembly above the lever assembly and has a retaining ring, a resetting resilient element and a turning rod. The combination mechanism is mounted in the housing assembly and has a pintle, multiple sleeves and multiple wheels. The mechanical-combination door lock has mechanical-combination detection and resetting functions and is allowed to be temporarily disabled while the door is open.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
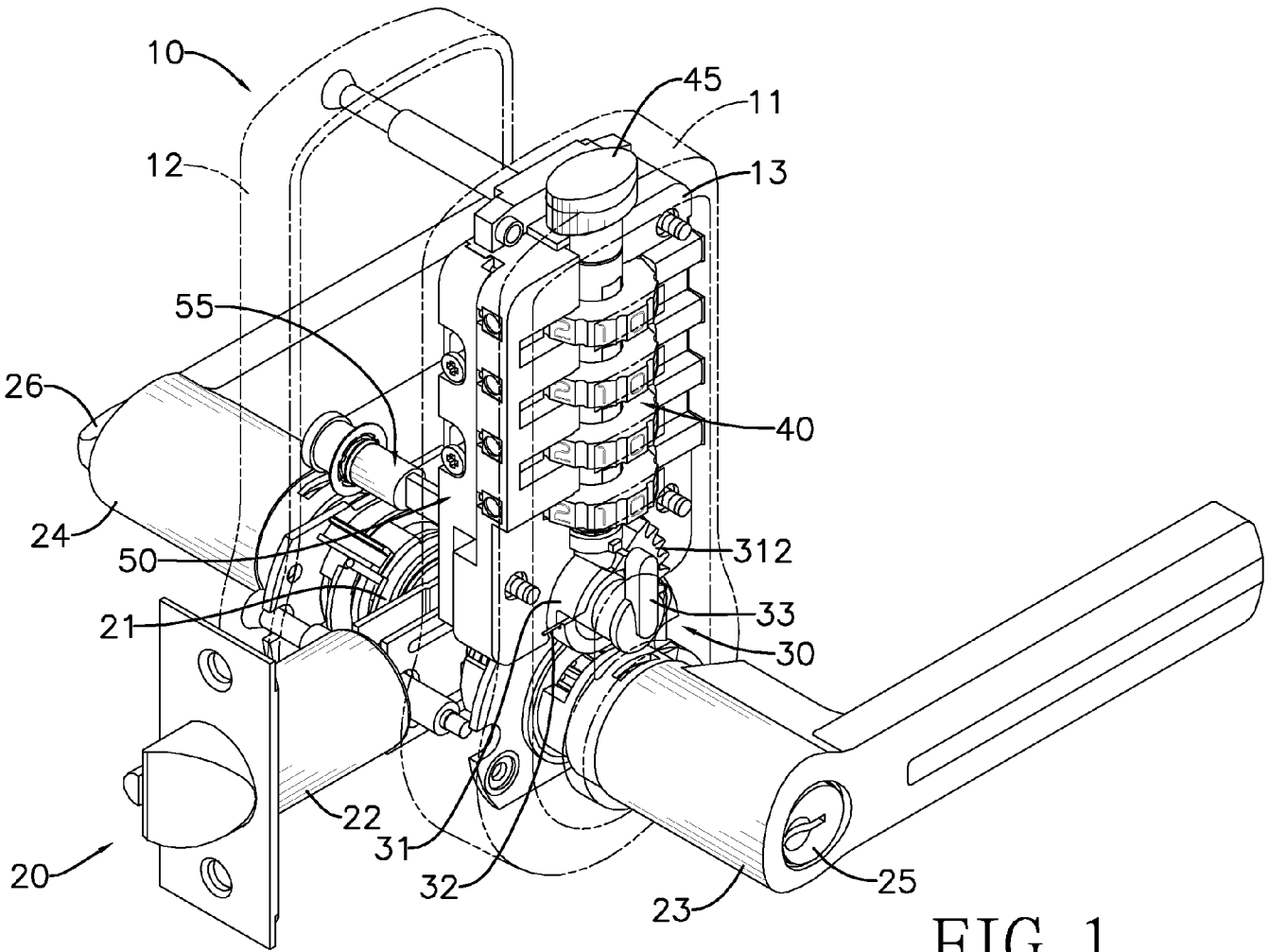
FIG. 1 is a perspective view of a mechanical-combination door lock in accordance with the present invention with a housing assembly of the mechanical-combination door lock shown in phantom lines.

With reference to FIGS. 1 to 4, a mechanical-combination door lock in accordance with the present invention is mounted on a door to lock or unlock the door and comprises a housing assembly 10, a lever assembly 20, a disable mechanism 30, a combination mechanism 40, a detecting mechanism 50 and a locating assembly 60.

Figure 2:
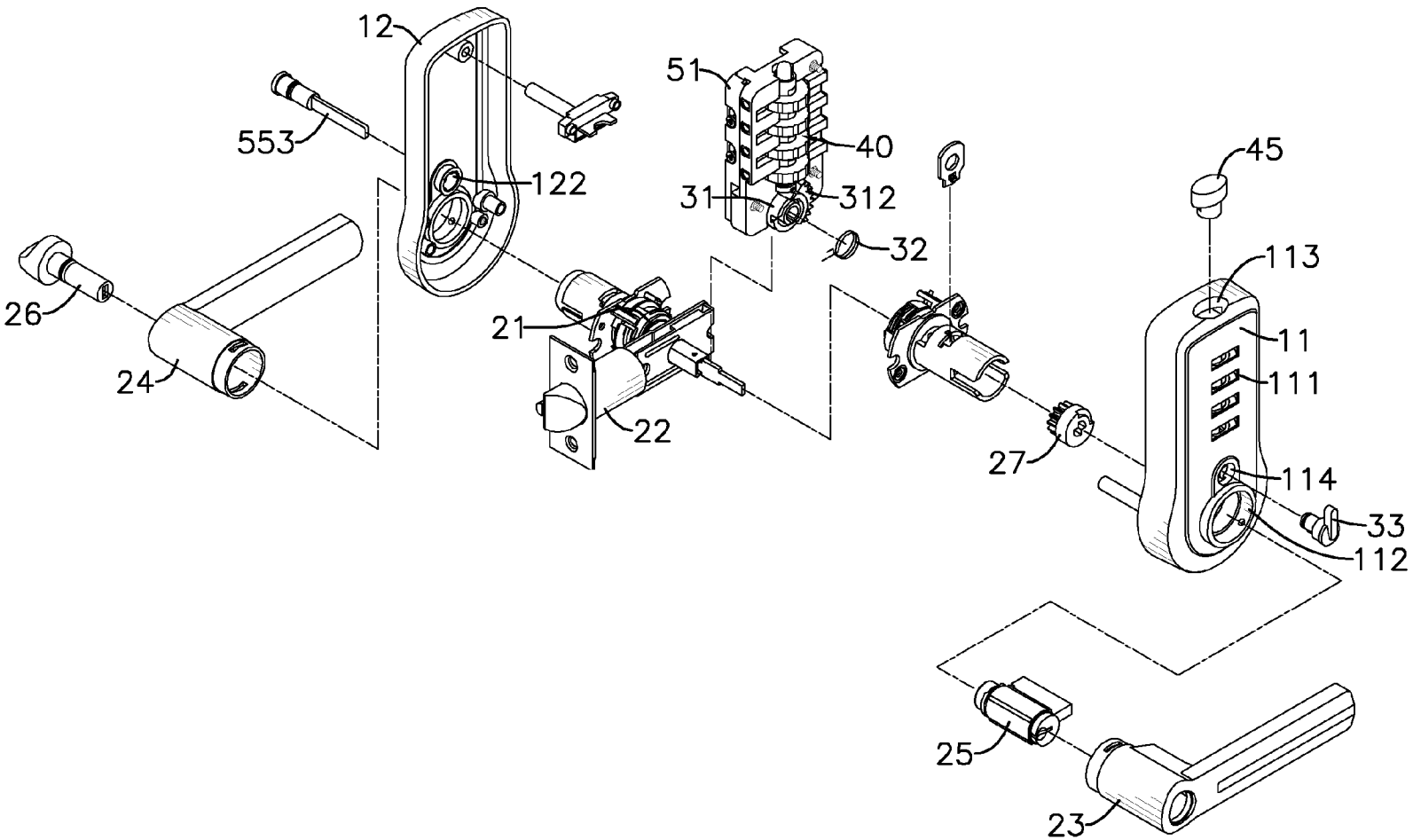
FIG. 2 is an exploded perspective view of the mechanical-combination door lock in FIG. 1.
Figure 3:
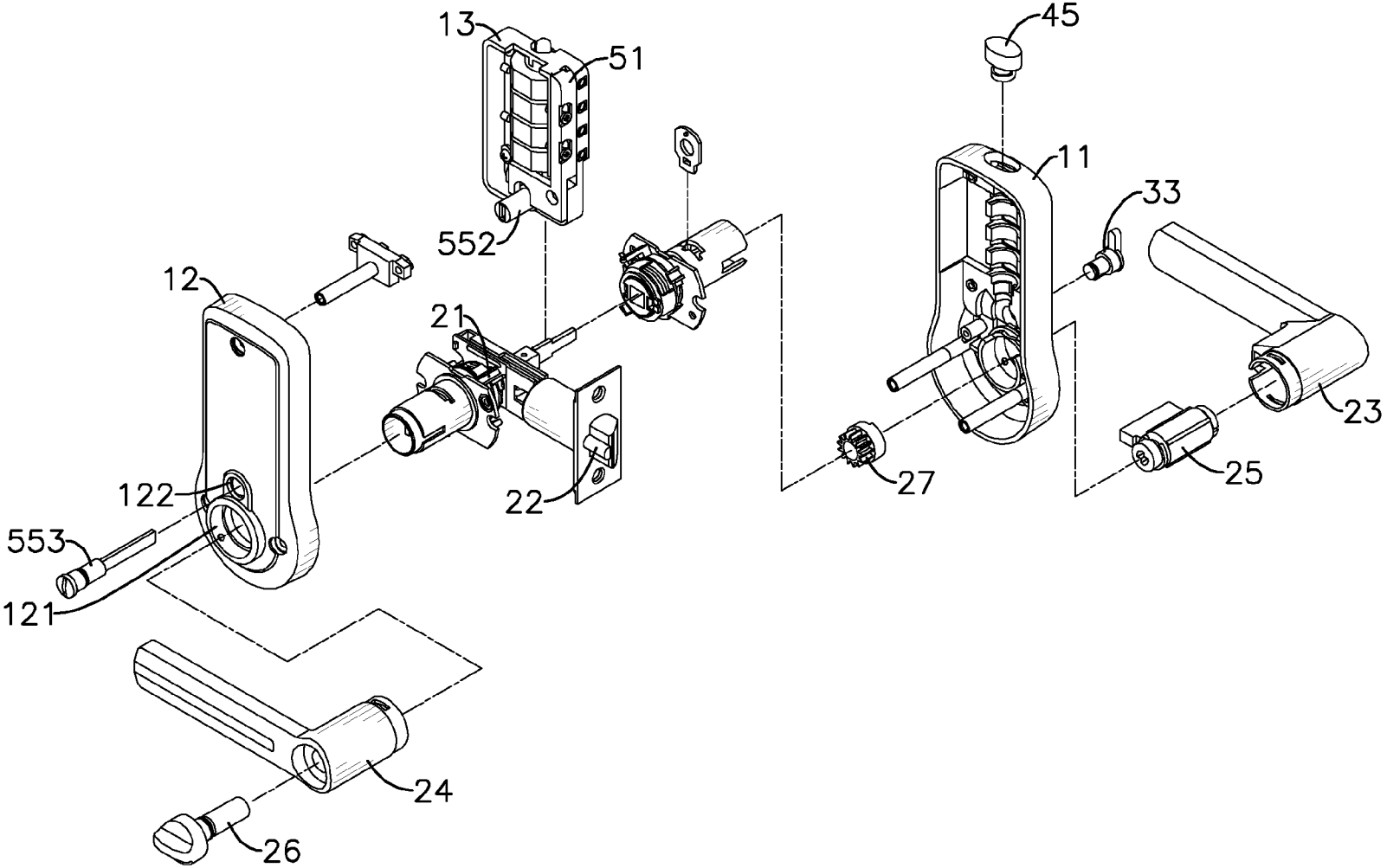
FIG. 3 is another exploded perspective view of the mechanical-combination door lock in FIG. 1.

With further reference to FIGS. 2 and 3, the housing assembly 10 is securely mounted on the door and has an outer housing 11, an inner housing 12 and a mounting bracket 13.

The outer housing 11 is securely mounted on an outer surface of the door and has an outer surface, a lower end, an upper end, multiple wheel holes 111, an outer lever hole 112, a button hole 113 and a rod hole 114. The wheel holes 111 are separately formed through the outer surface of the outer housing 11. The outer lever hole 112 is formed through the outer surface of the outer housing 11 and may be adjacent to the lower end of the outer housing 11. The button hole 113 is formed through the upper end of the outer housing 11. The rod hole 114 is formed through the outer surface of the outer housing 11 between the wheel holes 111 and the outer lever hole 112.

The inner housing 12 is securely mounted on an inner surface of the door, is connected to the outer housing 11 and has an inner surface, an inner lever hole 121 and a though hole 122. The inner lever hole 121 is formed through the inner surface of the inner housing 12 and aligns with the outer lever hole 112 of the outer housing 11. The through hole 122 is formed through the inner surface of the inner housing 12 adjacent to the inner lever hole 121.

Figure 4:
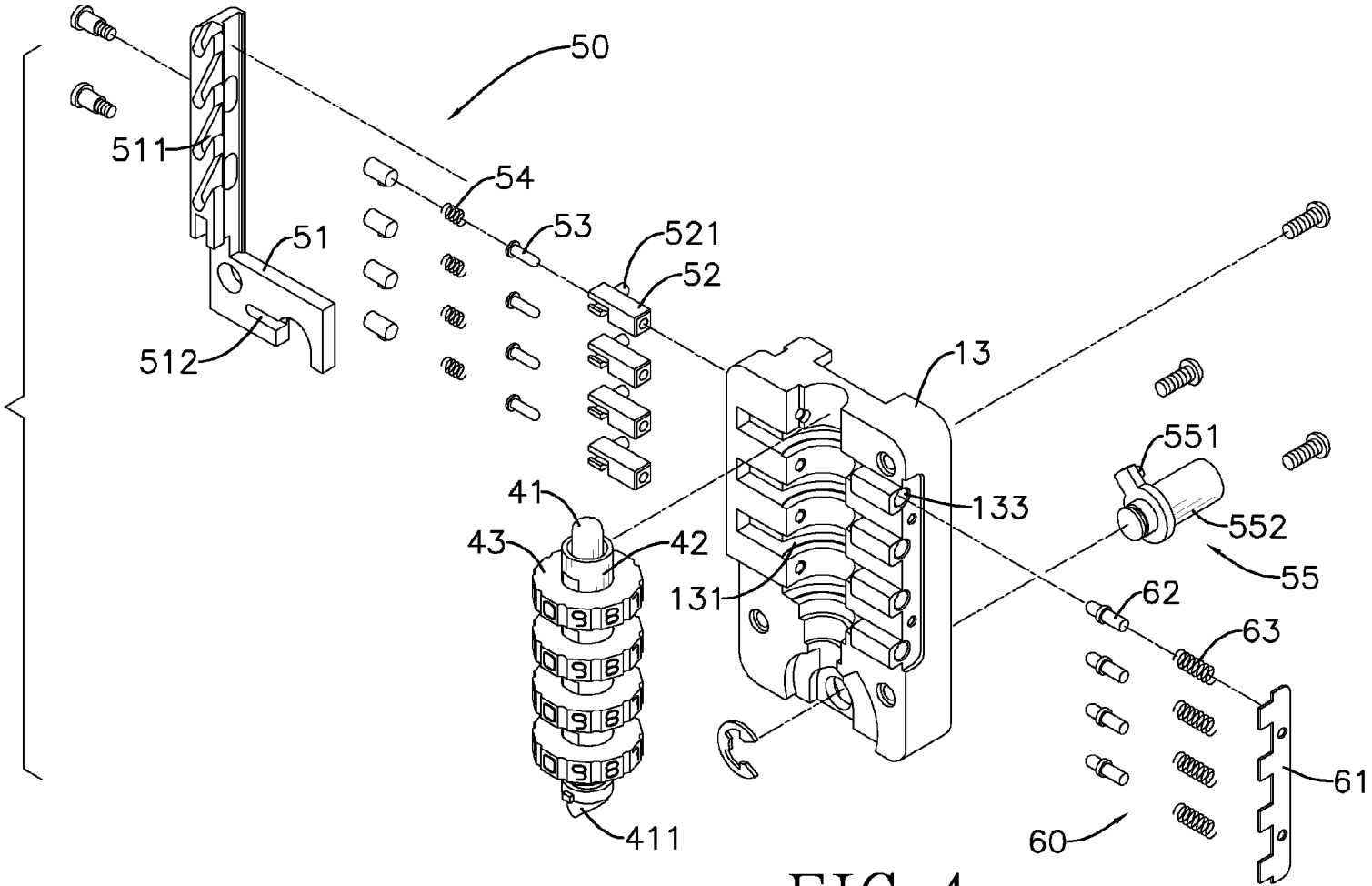
FIG. 4 is an enlarged exploded perspective view of a detecting mechanism and a locating assembly of the mechanical-combination door lock in FIG. 1.
Figure 5:
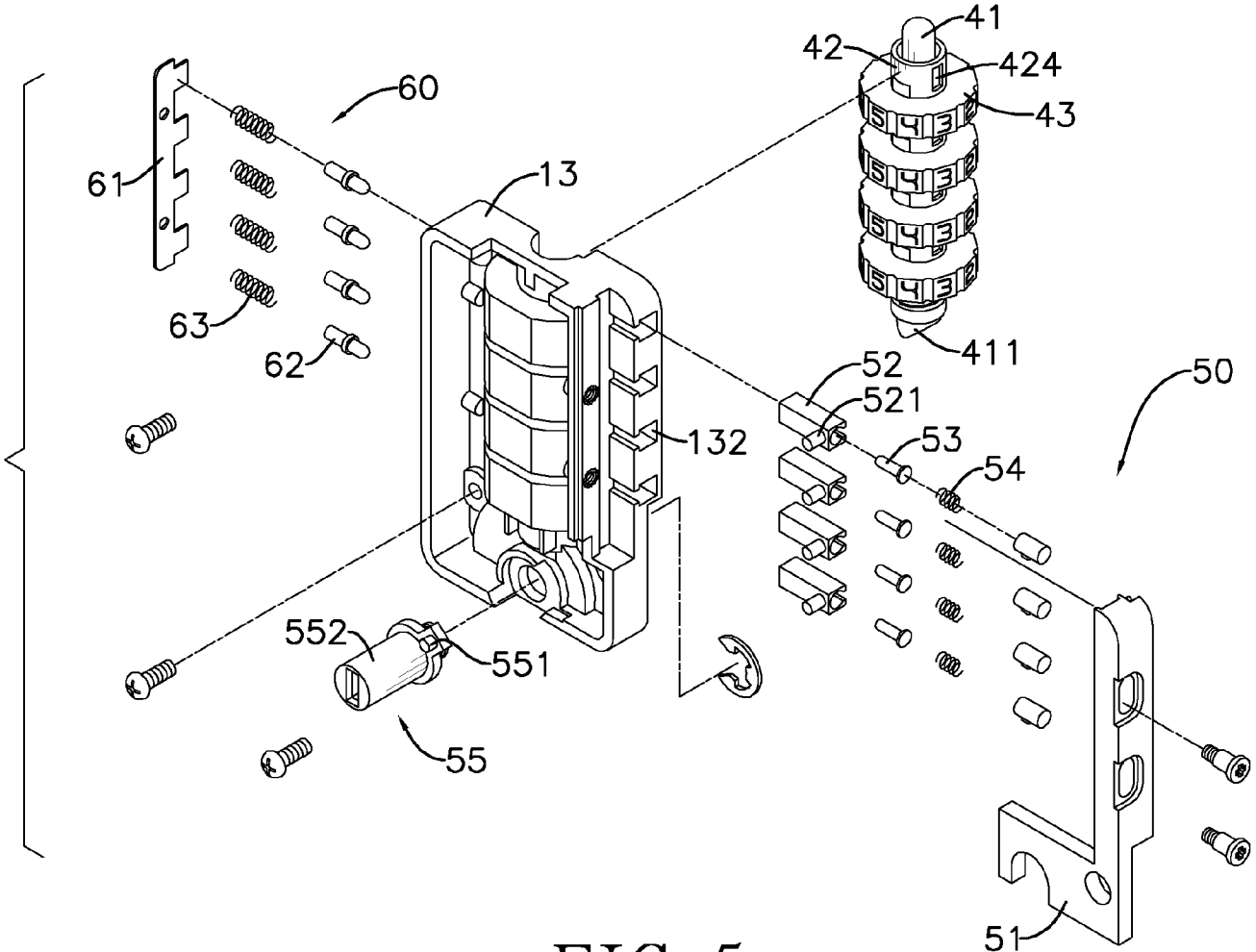
FIG. 5 is another enlarged exploded perspective view of a detecting mechanism and a locating assembly of the mechanical-combination door lock in FIG. 1.

With further reference to FIGS. 4 and 5, the mounting bracket 13 is mounted in the outer housing 11 and has an outer surface, two opposite sidewalls, a lower end, multiple wheel recesses 131, multiple detecting pinholes 132 and multiple locating pinholes 133. The wheel recesses 131 are separately formed in the outer surface of the mounting bracket 13 and respectively align with the wheel holes 111 of the outer housing 11. The detecting pinholes 132 are separately and transversally formed in one of the opposite sidewalls of the mounting bracket 13 and misalign with the wheel recesses 131. The locating pinholes 133 are separately and transversally formed in the other opposite sidewall of the mounting bracket 13 and respectively communicate with the wheel recesses 131.

With reference to FIG. 2, the lever assembly 20 is mounted though the housing assembly 10 and has a lock body 21, a lock bolt 22, an outer lever 23, an inner lever 24, a lock core 25, a lock rod 26 and a linking gear wheel 27.

The lock body 21 is mounted in the housing assembly 10 between the housings 11, 12 and is mounted through the door. The lock bolt 22 is connected to the lock body 21, is mounted on a side of the door between the housings 11, 12 and selectively locks or unlocks a door frame to open or close the door. The outer lever 23 is rotatably mounted through the outer lever hole 112 of the outer housing 11. The inner lever 24 is rotatably mounted through the inner lever hole 121 of the inner housing 12.

The lock core 25 is mounted securely in the outer lever 23, is connected to the lock body 21 and is driven only by a specific key to drive the lock body 21. The lock rod 26 is mounted through the inner lever 24, is connected to the lock body 21 and can be rotated to drive the lock body 21. The linking gear wheel 27 is mounted in the lock body 21 below the mounting bracket 13 and can be rotated with the lock core 25 or the lock rod 26 via the lock body 21.

With reference to FIGS. 1 to 3 and 9, the disable mechanism 30 is mounted in the housing assembly 10 between the outer housing 11 and the mounting bracket 13 above the lever assembly 20 and has a retaining ring 31, a resetting resilient element 32 and a turning rod 33.

The retaining ring 31 is rotatably mounted on the mounting bracket 13 above the linking gear wheel 27, aligns with the rod hole 114 of the outer housing 11 and has an outer periphery, a retaining recess 311 and a tooth segment 312. The retaining recess 311 is formed in the outer periphery of the retaining ring 31, may be V-shaped in cross-section and has two inclined surfaces. The tooth segment 312 is formed on and protrudes from the outer periphery of the retaining ring 31 and selectively engages the linking gear wheel 27 to enable the linking gear wheel 27 to rotate with the retaining ring 31. The resetting resilient element 32 is connected to the retaining ring 31 and the mounting bracket 13 to provide a resetting force to the retaining ring 31.

The turning rod 33 is mounted through the rod hole 114 of the outer housing 11, is connected securely to the retaining ring 31 and has an outer end and an inner end. The outer end of the turning rod 33 extends out of the rod hole 114 of the outer housing 11. The inner end of the turning rod 33 is connected securely to the retaining ring 31. A user can rotate the outer end of the turning rod 33 to enable the tooth segment 312 of the retaining ring 31 to engage the linking gear wheel 27. When the user sets the turning rod 33 free, the resetting resilient element 32 can rotate the retaining ring 31 and the turning rod 33 backwardly to the original position to enable the tooth segment 312 of the retaining ring 31 to disengage the linking gear wheel 27.

In addition, if the lock body 21 is driven by the lock core 25, the lock rod 26 or the linking gear wheel 27, the latch bolt 22 can be retractably moved in an unlock condition or un-retractably moved in a lock condition.

Figure 6:
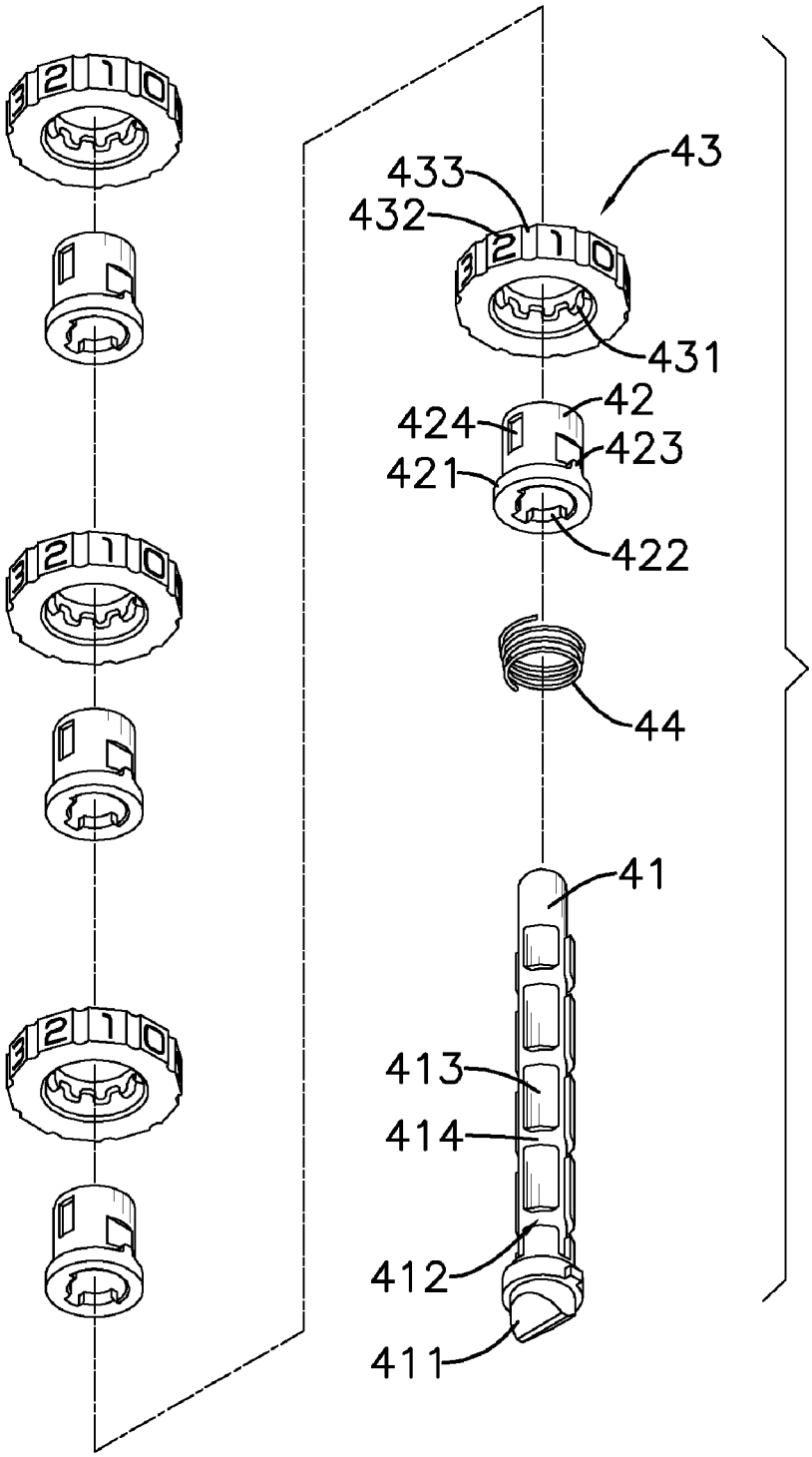
FIG. 6 is an enlarged exploded perspective view of a combination mechanism of the mechanical-combination door lock in FIG. 1.

With reference to FIGS. 1 and 6, the combination mechanism 40 is mounted in the housing assembly 10 between the outer housing 11 and the mounting bracket 13 and has a pintle 41, multiple sleeves 42, multiple wheels 43, a sleeve resilient element 44 and a button 45.

The pintle 41 is mounted through the wheel recesses 131 of the mounting bracket 13, is connected to the lever assembly 20 and has a lower end, an upper end, an external surface, a retaining protrusion 411 and multiple positioning segments 412. The lower end of the pintle 41 extends downwardly to the retaining ring 31 of the disable mechanism 30. The retaining protrusion 411 is formed on and protrudes downwardly from the lower end of the pintle 41, may be V-shaped in cross-section and selectively engages the retaining recess 311 of the retaining ring 31 between the inclined surfaces of the retaining recess 311.

The positioning segments 412 are axially formed on and arranged around the external surface of the pintle 41 at intervals between the retaining protrusion 411 and the upper end of the pintle 41. Each positioning segment 412 has multiple positioning protrusions 413 and multiple grooves 414. The positioning protrusions 413 of each one of the positioning segments 412 are separately and axially formed on the external surface of the pintle 41 and align with each other and each positioning protrusion 413 has a width. The widths of the positioning protrusions 413 of each one of the positioning segments 412 are not identical. The grooves 414 are respectively defined between the positioning protrusions 413 of a corresponding positioning segment 412 and communicate with the grooves 414 of the adjacent positioning segments 412.

With further reference to FIGS. 5 and 6, the sleeves 42 are mounted around the pintle 41, respectively align with the detecting pinholes 132 of the mounting bracket 13 and each sleeve 42 has an outer surface, an inner surface, a lower end, a limit ring 421, multiple positioning protrusions 422, at least one number protrusion 423 and a detecting recess 424. The limit ring 421 is formed around the outer surface of the sleeve 42 and may be adjacent to the lower end of the sleeve 42.

The positioning protrusions 422 of the sleeve 42 are separately formed on the inner surface of the sleeve 42, may be adjacent to the lower end of the sleeve 42 and are selectively and slidably mounted in corresponding grooves 414 of the pintle 41. Each positioning protrusion 422 of the sleeve 42 is selectively and slidably mounted around the pintle 41 between the positioning protrusions 413 of two specific and adjacent positioning segments 412 and has a width. The widths of the positioning protrusions 422 of the sleeve 42 are not identical. The at least one number protrusion 423 of the sleeve 42 is formed on the outer surface of the sleeve 42 and may be adjacent to the limit ring 421 of the sleeve 42. The detecting hole 424 is formed through the sleeve 42 near the upper end of the sleeve 42.

The wheels 43 are annular, are respectively and rotatably mounted around the sleeves 42, are respectively mounted in the wheel recesses 131 of the mounting bracket 13 and protrude out of corresponding wheel holes 111 of the outer housing 11 to allow being turned by users. Each wheel 43 has an inner surface, an outer surface, multiple number protrusions 431, multiple number regions 432 and multiple positioning recesses 433. The number protrusions 431 are formed on and protrude from the inner surface of the wheel 43 and two adjacent number protrusions 431 of the wheel 43 engage the at least one number protrusion 423 of a corresponding sleeve 42. The number regions 432 are formed on and protrude from the outer surface of the wheel 43 at intervals, one of the number regions 432 protrudes out of the corresponding wheel hole 111 of the outer housing 11 and each number region 432 has an external surface and a pattern. The pattern can be a number from zero to nine or a mark and is form on the external surface of the number region 432. The positioning recesses 433 are formed in the outer surface of the wheel 43 between the number regions 432.

The sleeve resilient element 44 is mounted around the pintle 41, abuts the retaining protrusion 411 of the pintle 41 and the lowest sleeve 42 to push the sleeves 42 to enable the number protrusions 423 of the sleeves 42 to securely engage between the adjacent number protrusions 431 of the corresponding wheels 43 and this can enable the sleeves 42 to rotate with the wheels 43 relative to the pintle 41.

The button 45 is mounted through the upper end of the outer housing 11, may be mounted in the button hole 113 of the outer housing 11 and abuts the uppermost sleeve 42. When the button 45 is pushed, the sleeves 42 are also pushed to axially move downward to the retaining protrusion 411 of the pintle 41 to enable the number protrusions 423 of the sleeves 42 to disengage from the number protrusions 431 of the wheels 43.

Figure 9:
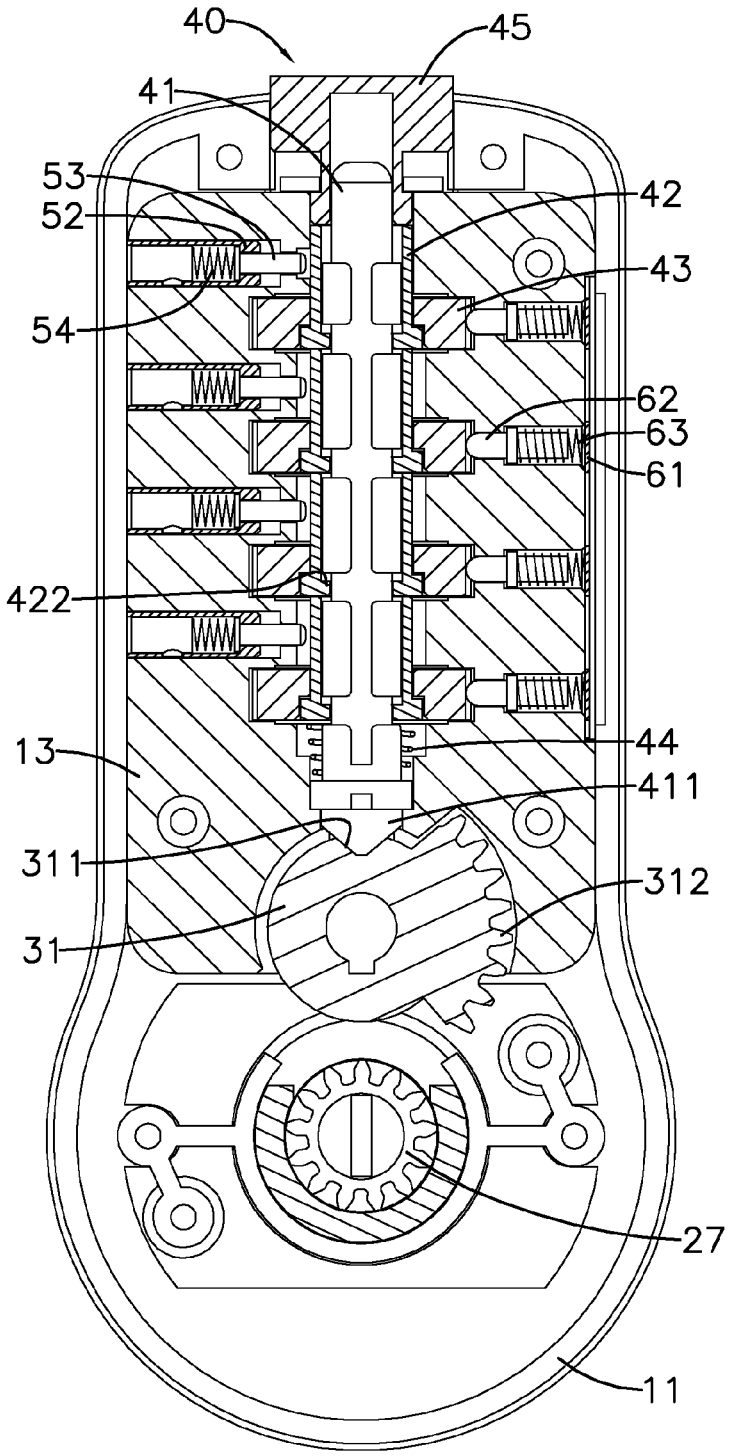
FIG. 9 is a front view in partial section of the mechanical-combination door lock in FIG. 1.

With reference to FIGS. 4, 5 and 9, the detecting mechanism 50 is securely mounted on the mounting bracket 13 of the housing assembly 10 and has a pushing frame 51, multiple pushing blocks 52, multiple detecting pins 53, multiple detecting resilient elements 54 and a driving element 55.

The pushing frame 51 is movably mounted on a corresponding opposite sidewall of the mounting bracket 13 that is formed the detecting pinholes 132 and has a upper end, a lower end, a sidewall, multiple oblique slots 511 and a transverse slot 512. The sidewall of the pushing frame 51 is movably mounted on the mounting bracket 13 and has an outer surface facing the detecting pinholes 132 of the mounting bracket 13. The oblique slots 511 are obliquely formed in the outer surface of the sidewall of the pushing frame 51 at intervals between the upper end and the lower end of the pushing frame 51 and respectively communicate with the detecting pinholes 132 of the mounting bracket 13. The transverse slot 512 is formed in the outer surface of the sidewall of the pushing frame 51 near the lower end.

Figure 7:
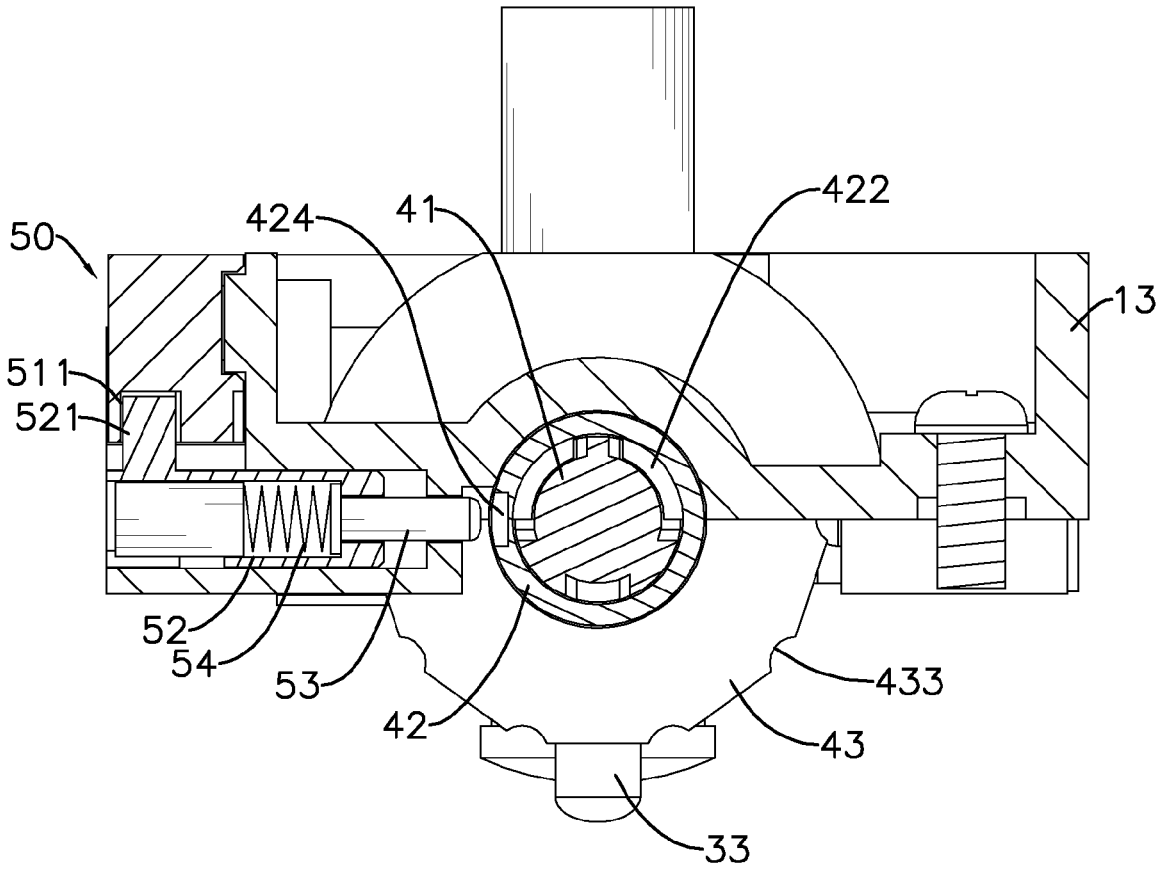
FIG. 7 is an operational top view in partial section of the combination mechanism and the detecting assembly of the mechanical-combination door lock in FIG. 1, showing the door lock being locked.

With reference to FIGS. 4, 5 and 7, the pushing blocks 52 are respectively mounted in the detecting pinholes 132 of the mounting frame 13, are respectively and slidably mounted in the oblique slots 511 of the pushing frame 51 and each pushing block 52 has an inner surface and a guiding pin 521. The inner surface of the pushing block 52 faces the outer surface of the sidewall of the pushing frame 51. The guiding pin 521 is formed on and protrudes from the inner surface of the pushing block 52 and is slidably mounted in a corresponding oblique slot 511 of the pushing frame 51.

The detecting pins 53 are respectively and movably mounted in and extend out of the pushing blocks 52, respectively extend to the sleeves 42 via the detecting pinholes 132 of the mounting bracket 13 and selectively mounted in the detecting recesses 424 of the sleeves 42. The detecting resilient elements 54 are respectively mounted in the pushing blocks 52 and respectively abut between the pushing blocks 52 and the detecting pins 53 to enable the detecting pins 53 to extend to the sleeves 42.

With further reference to FIGS. 1 to 4, the driving element 55 is mounted between the inner housing 12 and the mounting bracket 13, is connected to the pushing frame 51 and has a transmission rod 552 and a driving rod 553. The transmission rod 552 is connected to the lower end of the mounting bracket 13 below the wheel recesses 131 and has a periphery and an inserting pin 551. The inserting pin 551 is formed on and protrudes from the periphery of the transmission rod 552 and is slidably mounted in the transverse slot 512 of the pushing frame 51. The driving rod 553 is mounted through the through hole 122 of the inner housing 12 and has an outer end connected to the transmission rod 52. Thus, with reference to FIGS. 12 and 13, when the driving element 55 is turned, the pushing frame 51 is moved relative to the mounting bracket 13 along the directions of the oblique slots 511 by the engagement between the inserting pin 551 of the driving element 55 and the transverse slot 512 of the pushing frame 51.

Figure 8:
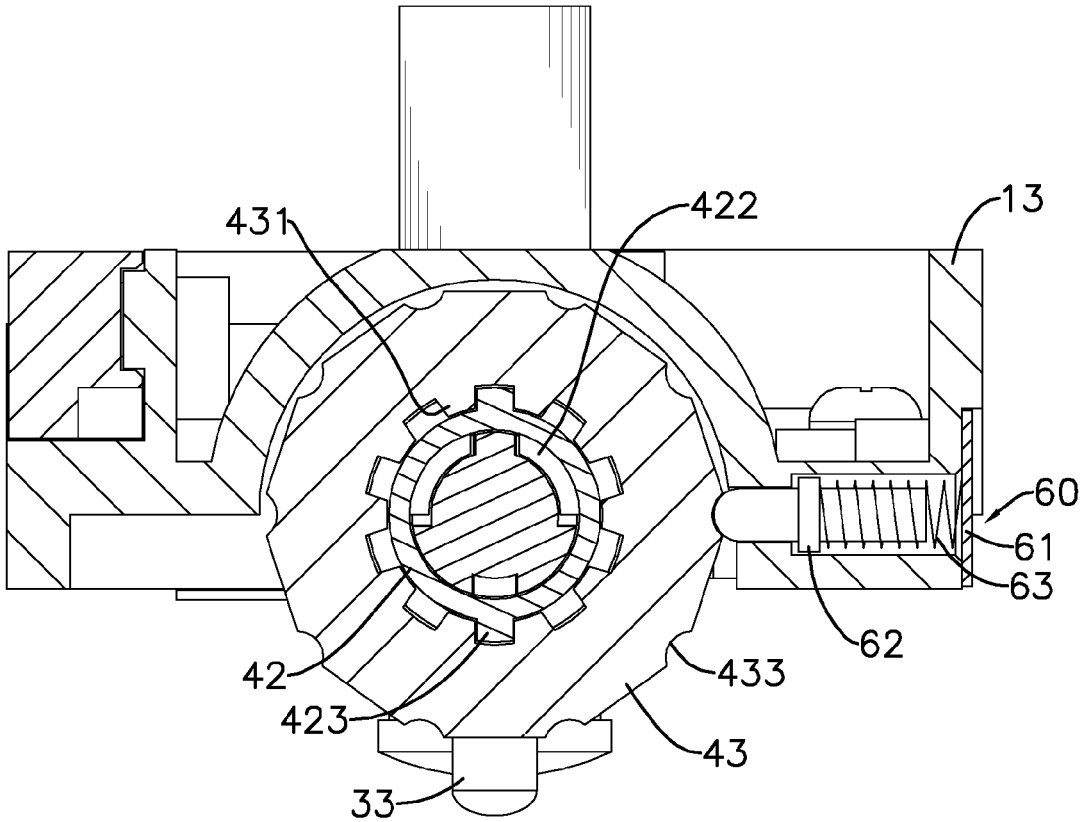
FIG. 8 is another operational top view in partial section of the combination mechanism and the detecting assembly of the mechanical-combination door lock in FIG. 1 showing the door lock being unlocked.

With further reference to FIGS. 4 and 8, the locating assembly 60 is securely mounted on the mounting frame 13 of the housing assembly 10 opposite to the detecting mechanism 50 and has a holding plate 61, multiple locating pins 62 and multiple locating resilient elements 63.

The holding plate 61 is mounted securely on the opposite sidewall of the mounting bracket 13 that formed the locating pinholes 133. The locating pins 62 are slidably mounted in the locating pinholes 133 of the mounting bracket 13, respectively extend into the wheel recesses 131 of the mounting bracket 13 and each locating pin 62 has an abutting end mounted in one of the positioning recesses 433 of a corresponding wheel 43 to enable one of the number regions 432 of the corresponding wheel 43 to move in the corresponding wheel hole 111 of the outer housing 11. The locating resilient elements 63 are mounted in the locating pinholes 133 between the holding plate 61 and the locating pins 62 to enable the abutting ends of the locating pins 62 respectively mounted in the corresponding positioning recesses of the wheels 43. Thus, the user can unlock the mechanical-combination door lock by arranging the numbers or the marks on the number regions 432 of the wheels 43. In addition, the engagement between the locating pins 62 and the positioning recesses 433 of the wheels 43 can provide a locating effect for the wheels 43 and also can provide a hand feeling when turns the wheels 43.

Figure 10:
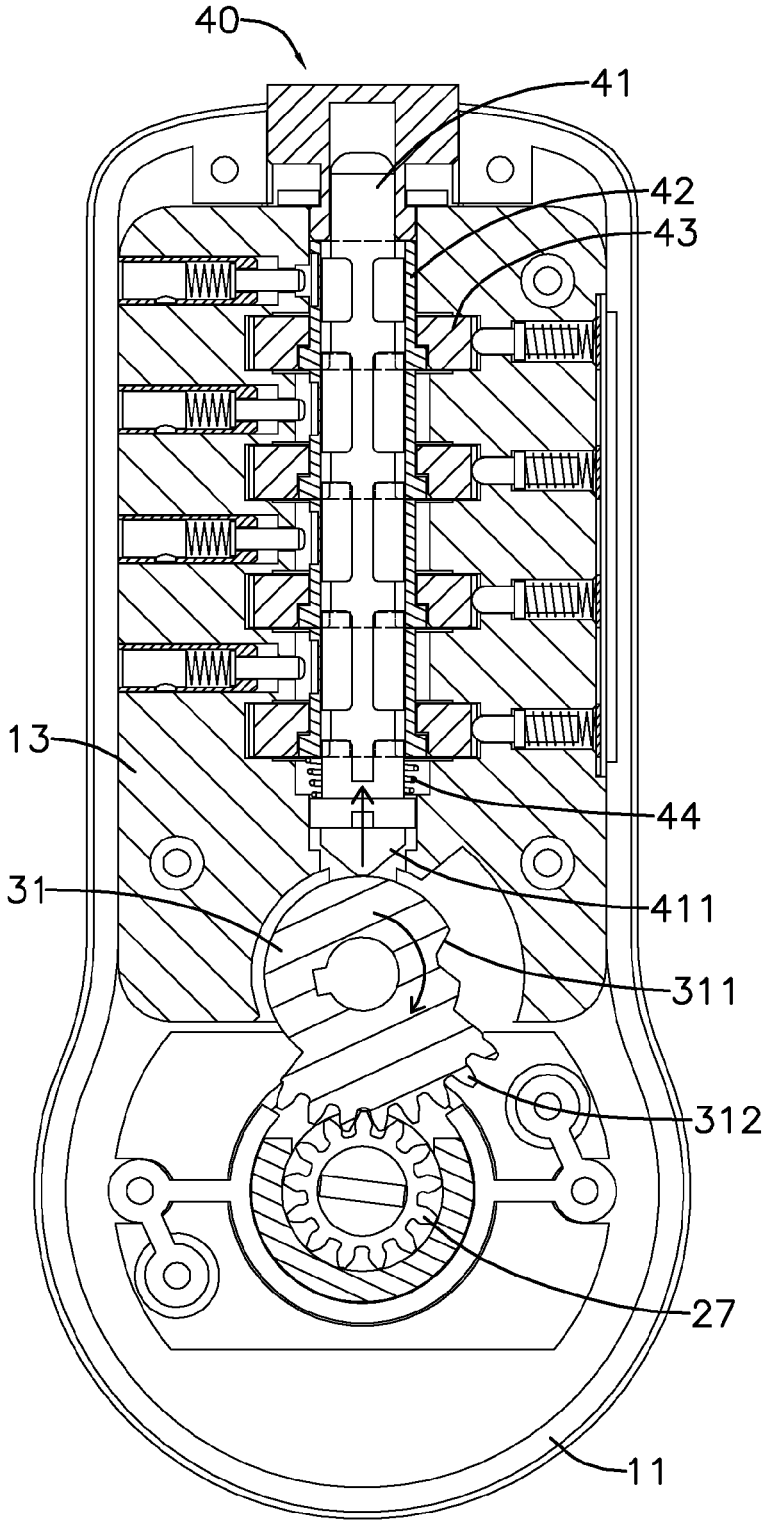
FIG. 10 is an operational front view in partial section of the mechanical-combination door lock in FIG. 1 showing a disable mechanism of the mechanical-combination door lock being unlocked.

With reference to FIGS. 6 and 9, when unlocking the mechanical-combination door lock, the wheels 43 of the combination mechanism 40 are turned to specific positions so the positioning protrusions 422 of the sleeves 42 are disposed between the positioning segments 412 of the pintle 41. Then, with reference to FIG. 10, when the turning rod 33 is turned by a user, the retaining ring 31 will enable the linking gear wheel 27 of the lever assembly 20 to rotate. On the one hand, the tooth segment 312 of the retaining ring 31 will engage the linking gear wheel 27 to enable the linking gear wheel 27 to rotate with the retaining ring 31. On the other hand, the pintle 41 will move upwardly relative to the mounting bracket 13 by disengaging the retaining recess 311 and abutting the outer periphery of the retaining ring 31. Then, the lock body 21 can be driven by the linking gear wheel 27 and the latch bolt 22 can be retractably moved in a unlock condition to allow the user to open the door by rotating the outer lever 23.

Furthermore, when the lever assembly 20 is set in an unlock condition by the disable mechanism 30 and the combination mechanism 40 as the above-mentioned, the wheels 43 can be turned to random positions to prevent someone from peeping at the mechanical-combination of the mechanical-combination door lock. In addition, no matter which positions the wheels 43 are, by the disengagement between the retaining protrusion 411 and the retaining recess 311, the outer lever 23 is able to turn to drive the latch bolt 22 via the lock body 21 and open the door freely for the convenience of passing through the door.

Contrariwise, when locking the mechanical-combination door lock, first the lock rod 26 of the lever assembly 20 is turned to drive the lock body 21 to enable the lock body 21 and the latch bolt 22 un-retractably moved in a lock condition. Then, the wheels 43 of the combination mechanism 40 are turned to random positions so the positioning protrusions 422 of the sleeves 42 are securely disposed in grooves 414 by engaging the positioning protrusions 413 of the pintle 41. Therefore, the pintle 41 is fixed and cannot be moved up or down and the retaining ring 31 cannot be rotated by the turning rod 33. When the retaining ring 31 cannot be rotated by the turning rod 33, the retaining recess 311 cannot disengage the retaining protrusion 411, and the lock body 21 and the latch bolt 22 cannot be driven by the outer lever 23 and the door is closed.

Figure 11:
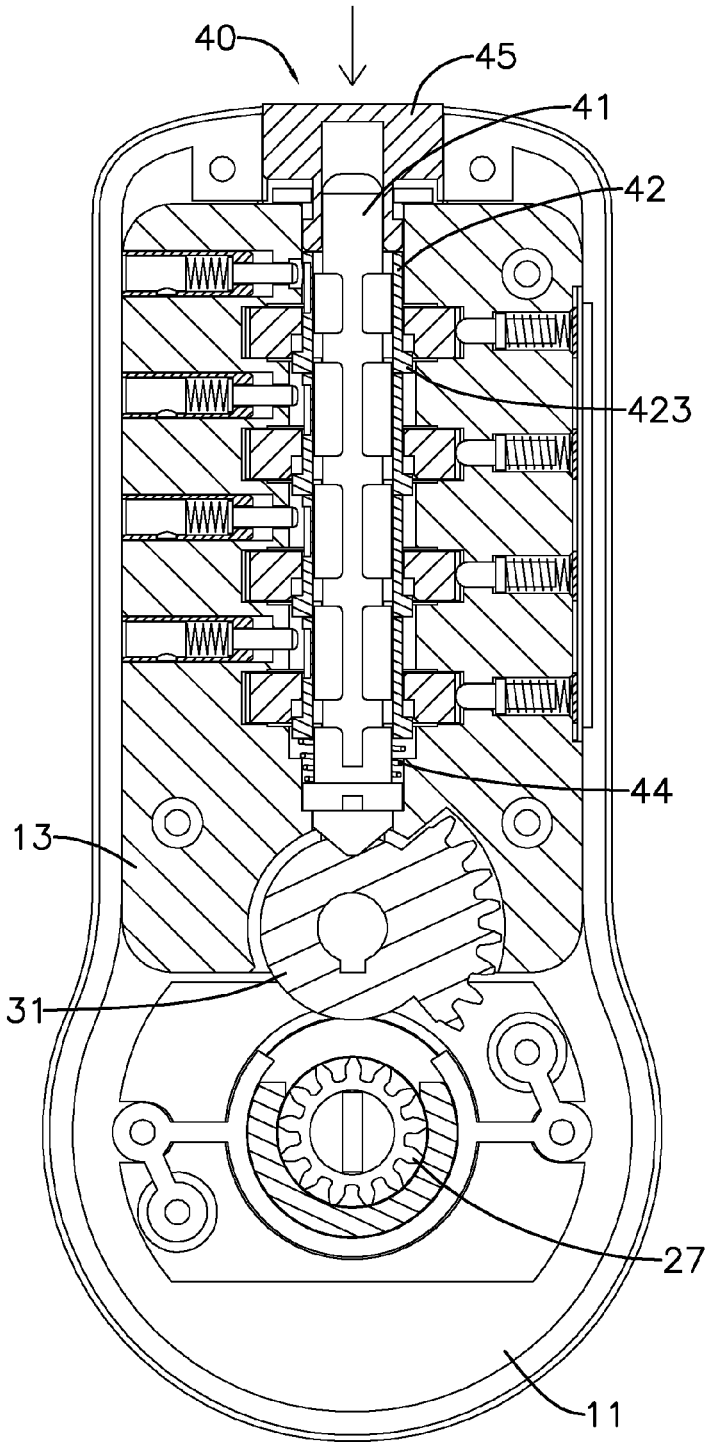
FIG. 11 is an operational front view in partial section of the mechanical-combination door lock in FIG. 1 showing the mechanical-combination being reset.

With further reference to FIG. 11, when a user wants to reset a mechanical-combination of the mechanical-combination door lock in accordance with the present invention, the mechanical-combination door lock is unlocked first. Then the button 45 of the combination mechanism 40 is pushed to make the sleeve 42 moving downwardly to press the sleeve resilient element 44, and this can enable the number protrusions 423 of the sleeves 42 to disengage from the number protrusions 431 of the wheels 43. Thus, the wheels 43 can able to be turned to reset the mechanical-combination. After a new mechanical-combination is set, the user can release the button 45 and the sleeve resilient element 44 will push the sleeves 42 upwardly to enable the number protrusions 423 of the sleeves 42 to engage the adjacent number protrusions 431 of the wheels 43 again.

Figure 12:
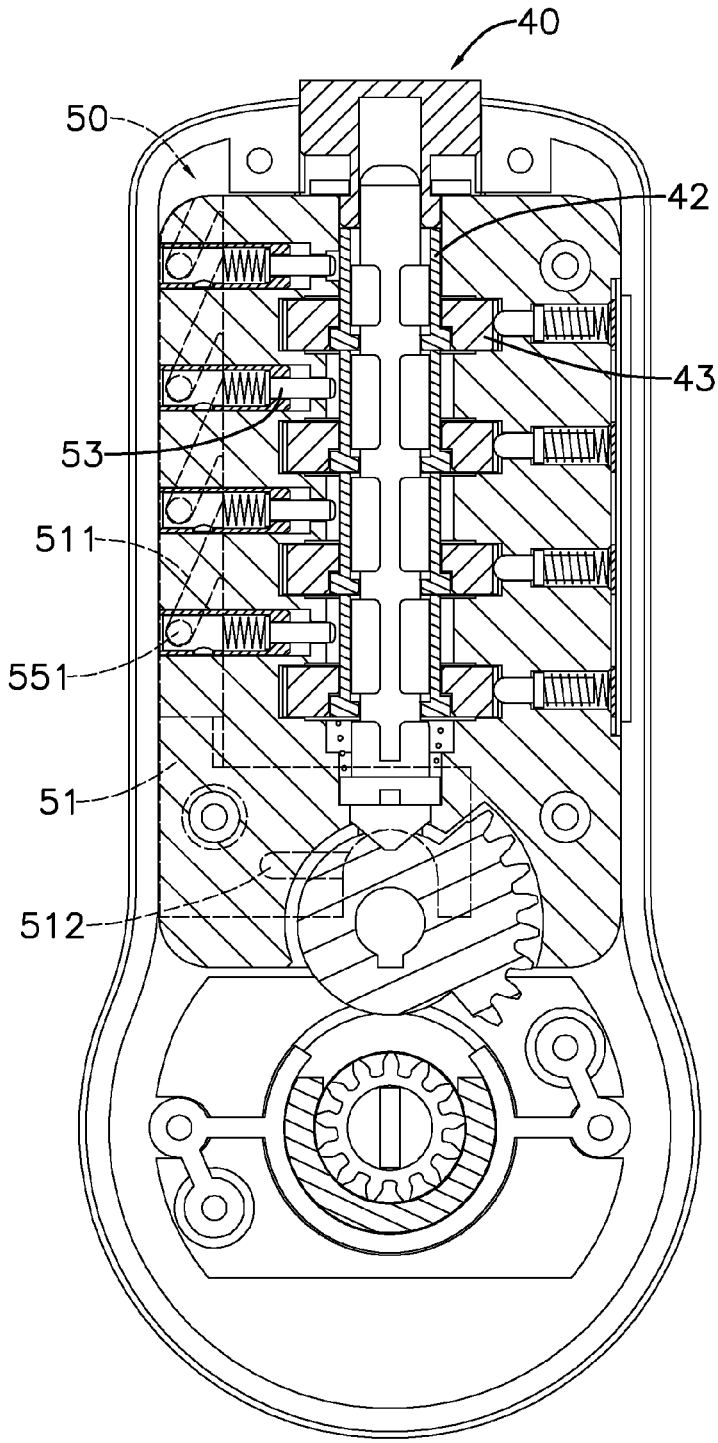
FIG. 12 is another front view in partial section of the mechanical-combination door lock in FIG. 1.
Figure 13:
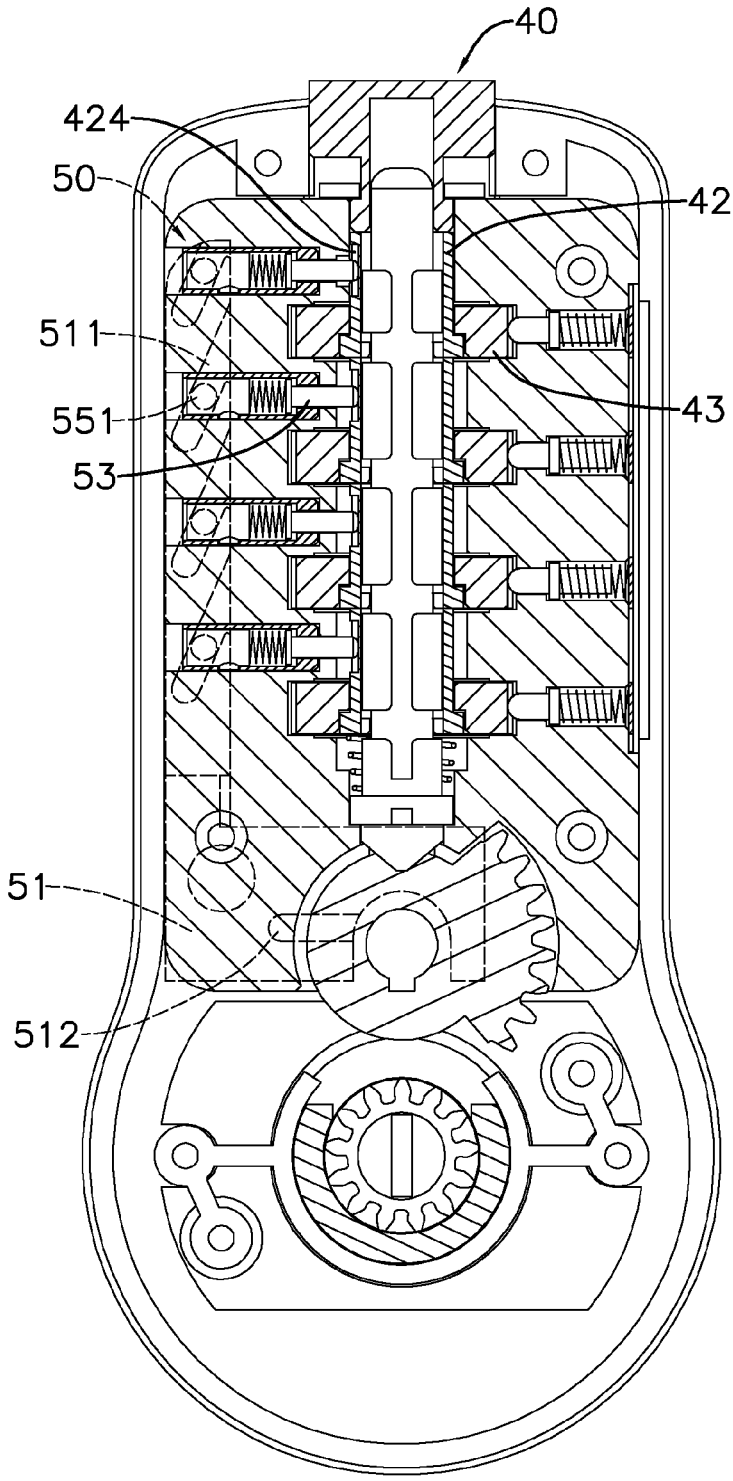
FIG. 13 is another operational front view in partial section of the mechanical-combination door lock in FIG. 1 showing the detecting mechanism of the mechanical-combination door lock being turned.

If the user forgets the mechanical-combination of the mechanical-combination door lock in accordance with the present invention, the user needs to use a key to drive the lock core 25 of the lever assembly 20 to allow the lock body 21 and the latch bolt 22 to set in an unlock condition to open the door. With reference to FIGS. 12 and 13, when the user moves into an inside of the door by using the key, the user can turn the driving rod 553 of the driving element 55 of the detecting mechanism 50 to enable the pushing frame 51 to move along the directions of the oblique slots 511 by the inserting pin 551 slidably mounting in the transverse slot 512 of the pushing frame 51. Then, the pushing blocks 52 and the detecting resilient elements 54 will push the detecting pins 53 moving inward to the sleeves 42 by the movement of the oblique slots 511 relative to the guiding pins 521 of the pushing blocks 52. At this time, the user can turn the wheels 43 to rotate the sleeves 42, when the detecting pins 53 further protrude into the detecting recesses 424 of the sleeves 42, the wheels 43 and the sleeves 42 are just moved at the positions of the combination number and the combination number is reminded.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A mechanical-combination door lock is mounted on a door with an outer surface, an inner surface and a side and the mechanical-combination door lock comprising:

a housing assembly being adapted to mount securely on the door;

a lever assembly mounted though the housing assembly and having a lock body mounted in the housing assembly and being adapted to mount through the door;

a lock bolt connected to the lock body and being adapted to mount on the side of the door;

an outer lever rotatably mounted through the housing assembly at the outer surface of the door;

an inner lever rotatably mounted through the housing assembly at the inner surface of the door;

a lock core mounted securely in the outer lever, connected to the lock body to drive the lock body;

a lock rod mounted through the inner lever, connected to the lock body to drive the lock body; and a linking gear wheel mounted in the lock body and rotated with the lock core or the lock rod via the lock body;

a disable mechanism mounted in the housing assembly above the lever assembly and having a retaining ring rotatably mounted in the housing assembly above the linking gear wheel and having an outer periphery;

a retaining recess formed in the outer periphery of the retaining ring; and a tooth segment formed on and protruding from the outer periphery of the retaining ring and selectively engaging the linking gear wheel to enable the linking gear wheel to rotate with the retaining ring;

a resetting resilient element connected to the retaining ring and the housing assembly to provide a resetting force to the retaining ring; and a turning rod mounted through the housing assembly, connected securely to the retaining ring and having an outer end extending out of the housing assembly; and an inner end connected securely to the retaining ring; and a combination mechanism mounted in the housing assembly and having a pintle mounted through the housing assembly, connected to the lever assembly and having a lower end extending downwardly to the retaining ring of the disable mechanism;

an upper end;

an external surface;

a retaining protrusion formed on and protruding downwardly from the lower end of the pintle and selectively engaging the retaining recess of the retaining ring; and multiple positioning segments axially formed on and arranged around the external surface of the pintle at intervals between the retaining protrusion and the upper end of the pintle and each positioning segment having multiple positioning protrusions separately and axially formed on the external surface of the pintle and aligning with each other; and multiple grooves respectively defined between the positioning protrusions of a corresponding positioning segment and communicating with the grooves of the adjacent positioning segments;

multiple sleeves mounted around the pintle and each sleeve having an outer surface;

an inner surface;

a lower end; and multiple positioning protrusions separately formed on the inner surface of the sleeve adjacent to the lower end of the sleeve and selectively and slidably mounted in corresponding grooves of the pintle and each positioning protrusion of the sleeve selectively and slidably mounted around the pintle between the positioning protrusions of two specific and adjacent positioning segments; and multiple wheels being annular and respectively and rotatably mounted around the sleeves.

2. The mechanical-combination door lock as claimed in claim 1, wherein the housing assembly has an outer housing being adapted to securely mount on the outer surface of the door;

an inner housing being adapted to securely mount on the inner surface of the door and connected to the outer housing; and a mounting bracket mounted in the outer housing;

the lock body is mounted in the housing assembly between the housings;

the outer lever is rotatably mounted through the outer housing;

the inner lever is rotatably mounted through the inner housing;

the disable mechanism is mounted in the housing assembly between the outer housing and the mounting bracket;

the linking gear wheel is mounted in the lock body below the mounting bracket;

the resetting resilient element is connected to the retaining ring and the mounting bracket to provide a resetting force to the retaining ring; and the combination mechanism is mounted in the housing assembly between the outer housing and the mounting bracket.

3. The mechanical-combination door lock as claimed in claim 2, wherein each sleeve of the combination mechanism has a detecting recess formed through the sleeve near the upper end of the sleeve;

the mechanical-combination door lock has a detecting mechanism securely mounted on the mounting bracket of the housing assembly and the detecting mechanism having a pushing frame movably mounted on an opposite sidewall of the mounting bracket and having an upper end;

a lower end;

a sidewall movably mounted on the mounting bracket and having an outer surface facing the opposite sidewall of the mounting bracket;

multiple oblique slots obliquely formed in the outer surface of the sidewall of the pushing frame at intervals between the upper end and the lower end of the pushing frame; and a transverse slot formed in the outer surface of the sidewall of the pushing frame near the lower end;

multiple pushing blocks respectively mounted in the mounting frame, respectively and slidably mounted in the oblique slots of the pushing frame and each pushing block having an inner surface facing the outer surface of the sidewall of the pushing frame; and a guiding pin formed on and protruding from the inner surface of the pushing block and slidably mounted in a corresponding oblique slot of the pushing frame;

multiple detecting pins respectively and movably mounted in and extending out of the pushing blocks, respectively extending to the sleeves via the mounting bracket and selectively mounted in the detecting recesses of the sleeves;

multiple detecting resilient elements respectively mounted in the pushing blocks and respectively abutting between the pushing blocks and the detecting pins to enable the detecting pins to extend to the sleeves; and a driving element mounted between the inner housing and the mounting bracket, connected to the pushing frame and having a transmission rod connected to the mounting bracket and having a periphery; and an inserting pin formed on and protruding from the periphery of the transmission rod and slidably mounted in the transverse slot of the pushing frame; and a driving rod mounted through the inner housing and having an outer end connected to the transmission rod.

4. The mechanical-combination door lock as claimed in claim 3, wherein each sleeve of the combination mechanism has a limit ring formed around the outer surface of the sleeve adjacent to the lower end of the sleeve; and at least one number protrusion formed on the outer surface of the sleeve adjacent to the limit ring of the sleeve;

each wheel of the combination mechanism has an inner surface;

an outer surface; and multiple number protrusions formed on and protruding from the inner surface of the wheel and two adjacent number protrusions of the wheel engaging the at least one number protrusion of a corresponding sleeve; and the combination mechanism has a sleeve resilient element mounted around the pintle, abutting the retaining protrusion of the pintle and the lowest sleeve to push the sleeves to enable the number protrusions of the sleeves to securely engage between the adjacent number protrusions of the corresponding wheels; and a button mounted through an upper end of the outer housing and abutting the uppermost sleeve.

5. The mechanical-combination door lock as claimed in claim 4, wherein each wheel of the combination mechanism has multiple number regions formed on and protruding from the outer surface of the wheel at intervals; and multiple positioning recesses formed in the outer surface of the wheel between the number regions; and the mechanical-combination door lock has a locating assembly securely mounted on the mounting frame of the housing assembly opposite to the detecting mechanism and the locating assembly having a holding plate mounted securely on the mounting bracket opposite to the pushing frame;

multiple locating pins slidably mounted in the mounting bracket and each locating pin has an abutting end mounted in one of the positioning recesses of a corresponding wheel; and multiple locating resilient elements mounted in the locating pinholes between the holding plate and the locating pins to enable the abutting ends of the locating pins respectively mounted in the corresponding positioning recesses of the wheels.

6. The mechanical-combination door lock as claimed in claim 5, wherein the retaining recess is V-shaped in cross-section and has two inclined surfaces; and the retaining protrusion is V-shaped in cross-section and selectively engages the retaining recess of the retaining ring between the inclined surfaces of the retaining recess.

7. The mechanical-combination door lock as claimed in claim 6, wherein each positioning protrusion of each one of the positioning segments has a width and the widths of the positioning protrusions of each positioning segment are not identical; and each positioning protrusion of each one of the sleeves has a width and the widths of the positioning protrusions of each sleeve are not identical.

8. The mechanical-combination door lock as claimed in claim 7, wherein the outer housing has an outer surface;

a lower end;

an upper end;

multiple wheel holes separately formed through the outer surface of the outer housing;

an outer lever hole formed through the outer surface of the outer housing adjacent to the lower end of the outer housing;

a button hole formed through the upper end of the outer housing; and a rod hole formed through the outer surface of the outer housing between the wheel holes and the outer lever hole;

the inner housing has an inner surface;

an inner lever hole formed through the inner surface of the inner housing and aligning with the outer lever hole of the outer housing; and a though hole formed through the inner surface of the inner housing adjacent to the inner lever hole;

the mounting bracket has an outer surface;

two opposite sidewalls;

a lower end;

multiple wheel recesses separately formed in the outer surface of the mounting bracket and respectively aligning with the wheel holes of the outer housing;

multiple detecting pinholes separately and transversally formed in one of the opposite sidewalls of the mounting bracket and misaligning with the wheel recesses; and multiple locating pinholes separately and transversally formed in the other opposite sidewall of the mounting bracket and respectively communicating with the wheel recesses;

the outer lever is rotatably mounted through the outer lever hole of the outer housing;

the inner lever is rotatably mounted through the inner lever hole of the inner housing;

the retaining ring is rotatably mounted on the mounting bracket above the linking gear wheel and aligns with the rod hole of the outer housing;

the turning rod is mounted through the rod hole of the outer housing and the outer end of the turning rod extends out of the rod hole of the outer housing;

the sleeves respectively align with the detecting pinholes of the mounting bracket;

the wheels are respectively mounted in the wheel recesses of the mounting bracket and protrude out of corresponding wheel holes of the outer housing;

one of the number regions of each wheel protrudes out of a corresponding wheel hole of the outer housing and each number region has an external surface and a pattern form on the external surface of the number region;

the button is mounted in the button hole of the outer housing;

the pushing frame is movably mounted on a corresponding opposite sidewall of the mounting bracket that formed the detecting pinholes;

the outer surface of the sidewall of the pushing frame faces the detecting pinholes of the mounting bracket;

the oblique slots respectively communicate with the detecting pinholes of the mounting bracket;

the pushing blocks are respectively mounted in the detecting pinholes of the mounting frame;

the detecting pins respectively extend to the sleeves via the detecting pinholes of the mounting bracket;

the transmission rod is connected to the lower end of the mounting bracket below the wheel recesses;

the driving rod is mounted through the through hole of the inner housing and has an outer end connected to the transmission rod;

the holding plate is mounted securely on the opposite sidewall of the mounting bracket that formed the locating pinholes; and the locating pins are slidably mounted in the locating pinholes of the mounting bracket and respectively extend into the wheel recesses of the mounting bracket.

9. The mechanical-combination door lock as claimed in claim 2, wherein each sleeve of the combination mechanism has a limit ring formed around the outer surface of the sleeve adjacent to the lower end of the sleeve; and at least one number protrusion formed on the outer surface of the sleeve adjacent to the limit ring of the sleeve;

each wheel of the combination mechanism has an inner surface;

an outer surface; and multiple number protrusions formed on and protruding from the inner surface of the wheel and two adjacent number protrusions of the wheel engaging the at least one number protrusion of a corresponding sleeve; and the combination mechanism has a sleeve resilient element mounted around the pintle, abutting the retaining protrusion of the pintle and the lowest sleeve to push the sleeves to enable the number protrusions of the sleeves to securely engage between the adjacent number protrusions of the corresponding wheels; and a button mounted through an upper end of the outer housing and abutting the uppermost sleeve.

10. The mechanical-combination door lock as claimed in claim 9, wherein each wheel of the combination mechanism has multiple number regions formed on and protruding from the outer surface of the wheel at intervals; and multiple positioning recesses formed in the outer surface of the wheel between the number regions; and the mechanical-combination door lock has a locating assembly securely mounted on the mounting frame of the housing assembly opposite to the detecting mechanism and the locating assembly having a holding plate mounted securely on the mounting bracket opposite to the pushing frame;

multiple locating pins slidably mounted in the mounting bracket and each locating pin has an abutting end mounted in one of the positioning recesses of a corresponding wheel; and multiple locating resilient elements mounted in the locating pinholes between the holding plate and the locating pins to enable the abutting ends of the locating pins respectively mounted in the corresponding positioning recesses of the wheels.

11. The mechanical-combination door lock as claimed in claim 10, wherein the retaining recess is V-shaped in cross-section and has two inclined surfaces; and the retaining protrusion is V-shaped in cross-section and selectively engages the retaining recess of the retaining ring between the inclined surfaces of the retaining recess.

12. The mechanical-combination door lock as claimed in claim 11, wherein each positioning protrusion of each one of the positioning segments has a width and the widths of the positioning protrusions of each positioning segment are not identical; and each positioning protrusion of each one of the sleeves has a width and the widths of the positioning protrusions of each sleeve are not identical.

13. The mechanical-combination door lock as claimed in claim 12, wherein the outer housing has an outer surface;

a lower end;

an upper end;

multiple wheel holes separately formed through the outer surface of the outer housing;

an outer lever hole formed through the outer surface of the outer housing adjacent to the lower end of the outer housing;

a button hole formed through the upper end of the outer housing; and a rod hole formed through the outer surface of the outer housing between the wheel holes and the outer lever hole;

the inner housing has an inner surface;

an inner lever hole formed through the inner surface of the inner housing and aligning with the outer lever hole of the outer housing; and a though hole formed through the inner surface of the inner housing adjacent to the inner lever hole;

the mounting bracket has an outer surface;

two opposite sidewalls;

a lower end;

multiple wheel recesses separately formed in the outer surface of the mounting bracket and respectively aligning with the wheel holes of the outer housing;

multiple detecting pinholes separately and transversally formed in one of the opposite sidewalls of the mounting bracket and misaligning with the wheel recesses; and multiple locating pinholes separately and transversally formed in the other opposite sidewall of the mounting bracket and respectively communicating with the wheel recesses;

the outer lever is rotatably mounted through the outer lever hole of the outer housing;

the inner lever is rotatably mounted through the inner lever hole of the inner housing;

the retaining ring is rotatably mounted on the mounting bracket above the linking gear wheel and aligns with the rod hole of the outer housing;

the turning rod is mounted through the rod hole of the outer housing and the outer end of the turning rod extends out of the rod hole of the outer housing;

the sleeves respectively align with the detecting pinholes of the mounting bracket;

the wheels are respectively mounted in the wheel recesses of the mounting bracket and protrude out of corresponding wheel holes of the outer housing;

one of the number regions of each wheel protrudes out of a corresponding wheel hole of the outer housing and each number region has an external surface and a pattern form on the external surface of the number region;

the button is mounted in the button hole of the outer housing;

the pushing frame is movably mounted on a corresponding opposite sidewall of the mounting bracket that formed the detecting pinholes;

the outer surface of the sidewall of the pushing frame faces the detecting pinholes of the mounting bracket;

the oblique slots respectively communicate with the detecting pinholes of the mounting bracket;

the pushing blocks are respectively mounted in the detecting pinholes of the mounting frame;

the detecting pins respectively extend to the sleeves via the detecting pinholes of the mounting bracket;

the transmission rod is connected to the lower end of the mounting bracket below the wheel recesses;

the driving rod is mounted through the through hole of the inner housing and has an outer end connected to the transmission rod;

the holding plate is mounted securely on the opposite sidewall of the mounting bracket that formed the locating pinholes; and the locating pins are slidably mounted in the locating pinholes of the mounting bracket and respectively extend into the wheel recesses of the mounting bracket.

* * * * *